US006640768B1

(12) United States Patent
Takashima et al.

(10) Patent No.: US 6,640,768 B1
(45) Date of Patent: Nov. 4, 2003

(54) LUBRICATION SYSTEM FOR DIRECT INJECTED ENGINE

(75) Inventors: Kazutoshi Takashima, Iwata (JP); Takao Nagai, Iwata (JP); Noriyoshi Hiraoka, Iwata (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/570,632

(22) Filed: May 15, 2000

(30) Foreign Application Priority Data

May 13, 1999 (JP) ..... 11-133245
May 14, 1999 (JP) ..... 11-135046

(51) Int. Cl.[7] ..... F01M 11/02

(52) U.S. Cl. ..... 123/196 R; 123/196 W; 123/196 CP

(58) Field of Search ..... 123/196 R, 196 W, 123/196 CP, 54.4, 195 P; 440/88, 900

(56) References Cited

U.S. PATENT DOCUMENTS

| | | | | | |
|---|---|---|---|---|---|
| 3,144,095 | A | * | 8/1964 | Trapp et al. | 123/196 CP |
| 4,480,602 | A | | 11/1984 | Kobayashi et al. | 123/73 AD |
| 4,770,132 | A | | 9/1988 | Sougawa | 123/73 A |
| 5,138,984 | A | | 8/1992 | Takashima | 123/73 AD |
| 5,193,500 | A | * | 3/1993 | Haft | 123/196 CP |
| 5,425,168 | A | * | 6/1995 | Bumbaco et al. | 29/720 |
| 5,513,608 | A | | 5/1996 | Takashima et al. | 123/196 W |
| 5,526,783 | A | | 6/1996 | Ito et al. | 123/73 AD |
| 5,537,959 | A | | 7/1996 | Ito | 123/73 AD |
| 5,570,662 | A | * | 11/1996 | Niemchick et al. | 123/196 CP |
| 5,597,051 | A | | 1/1997 | Moriya et al. | 123/73 AD |
| 5,623,895 | A | * | 4/1997 | Masuda et al. | 123/54.4 |
| 5,669,358 | A | * | 9/1997 | Osakabe | 123/509 |
| 5,701,872 | A | * | 12/1997 | Kaku et al. | 123/495 |
| 5,915,350 | A | | 6/1999 | Suzuki et al. | 123/196 R |
| 6,041,892 | A | | 3/2000 | Watanabe et al. | 123/196 W |
| 6,070,564 | A | | 6/2000 | Hiraoka et al. | 123/198 R |
| 6,286,476 | B1 | | 9/2001 | Hiraoka et al. | 123/196 W |
| 6,293,233 | B1 | | 9/2001 | Hiraoka | 123/73 AD |
| 6,318,331 | B1 | | 11/2001 | Hiraoka et al. | 123/196 R |
| 6,371,246 | B1 | | 4/2002 | Watanabe et al. | 123/196 W |

* cited by examiner

*Primary Examiner*—Hieu T. Vo
*Assistant Examiner*—Hai H. Huynh
(74) *Attorney, Agent, or Firm*—Knobbe, Martens, Olson & Bear, LLP

(57) ABSTRACT

A lubrication system for a direct injected V-type two-cycle engine is disclosed having a lubricant pump adapted to discharge lubricant into each crankcase chamber of the engine through ports positioned adjacent the downstream side of reed valves of the air intake system. Ports supplying lubricant to cylinders in the right cylinder bank of the engine extend through a left wall of the corresponding crankcase chamber. Ports supplying lubricant to cylinders in the left cylinder bank of the engine extend through a right wall of the corresponding crankcase chamber. During engine assembly, the lubricant pump is manually driven before it is mechanically installed so as to fill the attached supply hoses with lubricant. The pump delivers lubricant to each crankcase chamber at a rate high enough to avoid lubricant carbonization at engine idle and low enough to avoid lubricant resistance to crankshaft rotation, which may make the engine difficult to start.

28 Claims, 7 Drawing Sheets

LUBRICATION SYSTEM FOR DIRECT INJECTED ENGINE

RELATED APPLICATIONS

This application claims priority to Japanese applications Serial No.: Hei 11-135046, filed May 14, 1999, and Hei 11-133245, filed May 13, 1999.

BACKGROUND OF THE INVENTION

1. Field of the Invention

This invention relates to an engine lubricating system and has particular applicability to a fuel injected two cycle engine.

2. Description of the Related Art

Two cycle internal combustion engines are typically lubricated by supplying lubricant through the engine's induction and porting system for lubricating the various moving components of the engine. Lubricant can be supplied in a wide variety of manners. For example; lubricant may be mixed with fuel, may be sprayed into the induction system of the engine, may be delivered directly to certain components of the engine, or may be supplied by any combination of the above.

In conventional two cycle engines, air from an air intake system travels through reed valves into a crankcase chamber of the engine. Air from the crankcase chamber is supplied to the cylinders for combustion. Typically, fuel such as gasoline is mixed with lubrication oil and supplied to the air flow on an upstream side of the reed valves. The viscosity of this fuel/lubricant mixture is low in comparison with a typical lubricant alone. Because of its low viscosity, the mixture is easily sprayed and distributed to various parts of the engine for lubrication.

In order to reduce unburned hydrocarbons and engine exhaust emissions, many internal combustion engines now employ direct fuel injection, wherein the fuel is directly injected into the cylinders. In these engine arrangements, the fuel is not mixed with lubricant. As a result, the viscosity of the lubricant is increased and the lubricant is not smoothly sprayed and distributed. Due to its high viscosity, lubricant particles tend to stick together during distribution. Inconsistent lubrication of various engine components can occur at an increased frequency, possibly preventing even distribution of lubricant over the engine components. Adequate lubricant distribution is desired to protect engine components, especially during the break-in period. Excessive lubrication, however, may cause drawbacks such as increased lubricant consumption and possible decreased engine performance.

Accordingly, there is a need in the art for a two-cycle, fuel-injected engine lubrication system which promotes consistent and thorough distribution of lubricant to moving components of the engine, assures adequate lubrication during break-in of the engine, and provides a volume of lubricant adapted to promote lubricant effectiveness and minimize lubricant consumption.

SUMMARY OF THE INVENTION

In accordance with one aspect, the present invention includes an internal combustion engine comprising a first cylinder formed in a first cylinder bank and a second cylinder formed in a second cylinder bank. The cylinder banks are oriented in a V-shaped formation with the first cylinder bank being generally on a first side of the engine and the second cylinder bank being generally on a second side of the engine. A crankcase encloses at least a portion of a crankshaft therein. The crankshaft is adapted to rotate in a manner creating a swirling flow of air within the crankcase, which is divided into at least a first crankcase chamber communicating with the first cylinder and a second crankcase chamber communicating with the second cylinder. A first lubricant insertion port opens into the first crankcase chamber from the second side of the engine, and a second lubricant insertion port opens into the second crankcase chamber from the first side of the engine. The lubricant insertion ports communicate with a source of lubricant. The second lubricant insertion port opens into the second crankcase chamber in a direction substantially opposite the swirling flow. The source of lubricant is regulated by a control mechanism so that each lubricant insertion port delivers about 20–55 cc/hr of lubricant during engine idle.

Another aspect of the present invention involves an internal combustion engine comprising a first cylinder formed in a first cylinder bank and a second cylinder formed in a second cylinder bank. The cylinder banks are oriented in a V-shaped formation with the first cylinder bank being generally on a first side of the engine and the second cylinder bank being generally on a second side of the engine. A crankcase encloses at least a portion of a crankshaft therein and is divided into at least a first crankcase chamber communicating with the first cylinder and a second crankcase chamber communicating with the second cylinder. A first lubricant insertion port opens into the first crankcase chamber from the second side of the engine, and a second lubricant insertion port opens into the second crankcase chamber from the first side of the engine.

A still further aspect of the present invention involves an internal combustion engine comprising at least one variable volume combustion chamber defined by at least a pair of components that move relative to each other. A crankcase at least partially encloses a crankshaft therein and has an air guide. The air guide communicates with an air inlet device and is adapted to conduct a flow of air into the crankcase. The crankshaft communicates with one of the combustion chamber components and is adapted to rotate in a manner creating a swirling flow of air within the crankcase. A lubricant insertion port communicates with a source of lubricant and opens into the crankcase in a direction substantially opposite the swirling flow.

In accordance with a still further aspect of the present invention, an internal combustion engine has at least one variable volume combustion chamber defined by at least a pair of components that move relative to each other. A fuel injector communicates with the combustion chamber and is adapted to direct a flow of fuel into the combustion chamber. A crankcase encloses a crankshaft therein and has an air guide. The air guide communicates with an air inlet device and is adapted to conduct a flow of air into the crankcase. The crankshaft is connected to one of the combustion chamber components and is adapted to rotate in a first rotation direction. A scavenge system is adapted to supply air from the crankcase to the combustion chamber. A lubricant supply system comprises an insertion port and a control mechanism. The insertion port communicates with a source of lubricant and is adapted to conduct a flow of lubricant into the crankcase. The control mechanism is adapted to regulate the volume flow of lubricant so that, during engine idle, about 20–55 cc/hr of lubricant is delivered to the crankcase.

Another aspect of the present invention also includes an internal combustion engine having at least one variable volume combustion chamber defined by at least a pair of components that move relative to each other. A fuel injector communicates with the combustion chamber and directs a flow of fuel into the combustion chamber. A. crankcase encloses a crankshaft therein and has an air guide which communicates with an air inlet device and is adapted to conduct a flow of air into the crankcase. The crankshaft is connected to one of the combustion chamber components and rotates in a first rotation direction. A scavenge system supplies air from the crankcase to the combustion chamber. A lubricant supply system comprises an insertion port and a control mechanism. The insertion port communicates with a source of lubricant and conducts a flow of lubricant into the crankcase. The control mechanism regulates the volume flow of lubricant during engine idle between a first delivery rate and a second delivery rate. The first delivery rate is selected to supply a sufficient volume of lubricant to inhibit carbonization of the lubricant, and the second delivery rate is selected to supply a small enough volume of lubricant so that lubricant resistance to crankshaft rotation will not hinder engine start.

An additional aspect of the present invention includes a method of assembling an internal combustion engine. The method includes providing a crankcase comprising a rotatable crankshaft, providing a lubricant pump, providing a source of lubricant, placing the pump in communication with the source of lubricant, placing the pump into communication through a hose with a lubricant insertion port, the port being adapted to communicate lubricant to the crankcase, driving the pump to at least partially fill the hose with lubricant, and then connecting the pump to a mechanical drive device.

The above-discussed aspects of the invention are particularly well suited with engines operating on a crankcase compression, two-cycle combustion principle; however, many of the disclosed aspects of the invention can also be used with engine types that operate on other combustion principles.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, those skilled in the art will recognize that the invention may be embodied or carried out in a manner that achieves or optimizes one advantage or group of advantages as taught herein without necessarily achieving other objects or advantages as may be taught or suggested herein.

All of these aspects and features are intended to be within the scope of the invention herein disclosed. These and other aspects, features and advantages of the present invention will become readily apparent to those skilled in the art from the following detailed description of the preferred embodiment having reference to the attached figures, the invention not being limited to the particular preferred embodiment disclosed.

DETAILED DESCRIPTION OF THE PREFERRED EMBODIMENT

Figure 1:
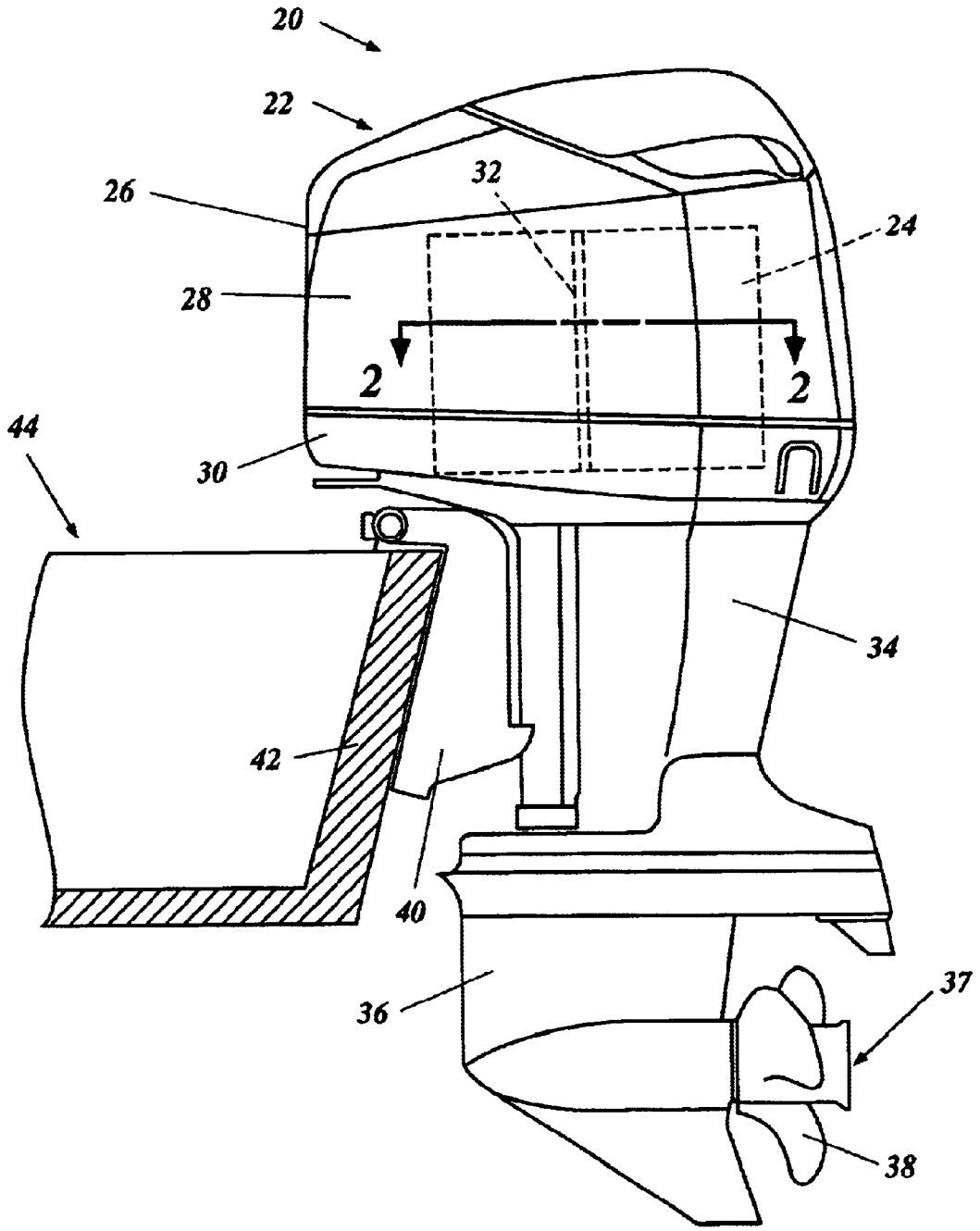
FIG. 1 is a side elevational view of an outboard motor including an engine having features in accordance with an embodiment of the invention, shown attached to the transom of a watercraft (shown partially and in cross-section).

With initial reference to FIG. 1, an outboard motor 20 that includes an engine constructed in accordance with an embodiment of the invention is illustrated. The present invention is herein described in conjunction with such an outboard motor for explanation of an environment in which the invention may be employed. Outboard motors often use two cycle internal combustion engines having output shafts that rotate about a vertical axis. Although the present engine has particular applicability with this arrangement, it is to be understood that the invention may be employed with engines having other orientations and applications, and which operate on other combustion principles.

The outboard motor 20 includes a power head 22 which includes an internal combustion engine 24 enclosed within a protective cowling 26. The cowling comprises an upper cowling member 28 and a lower cowling member. 30.

As is typical with outboard motor practice, the engine 24 is supported within the power head 22 so that its output shaft 32 rotates about a generally vertical axis. The crankshaft 32 is coupled to a drive shaft (not shown) that depends through and is journaled within a drive shaft housing 34.

The drive shaft housing 34 extends downward from the cowling 26 and terminates in a lower unit 36. The transmission selectively establishes a driving condition of a propulsion device 37. In the illustrated embodiment, the propulsion device 37 is a propeller having a plurality of propeller blades 38. The transmission desirably is a forward/neutral/reverse-type transmission so as to drive the watercraft in any of these operational states.

The outboard motor 20 further preferably includes a mount bracket 40 by which it is mounted onto a transom 42 of a watercraft 44.

Figure 2:
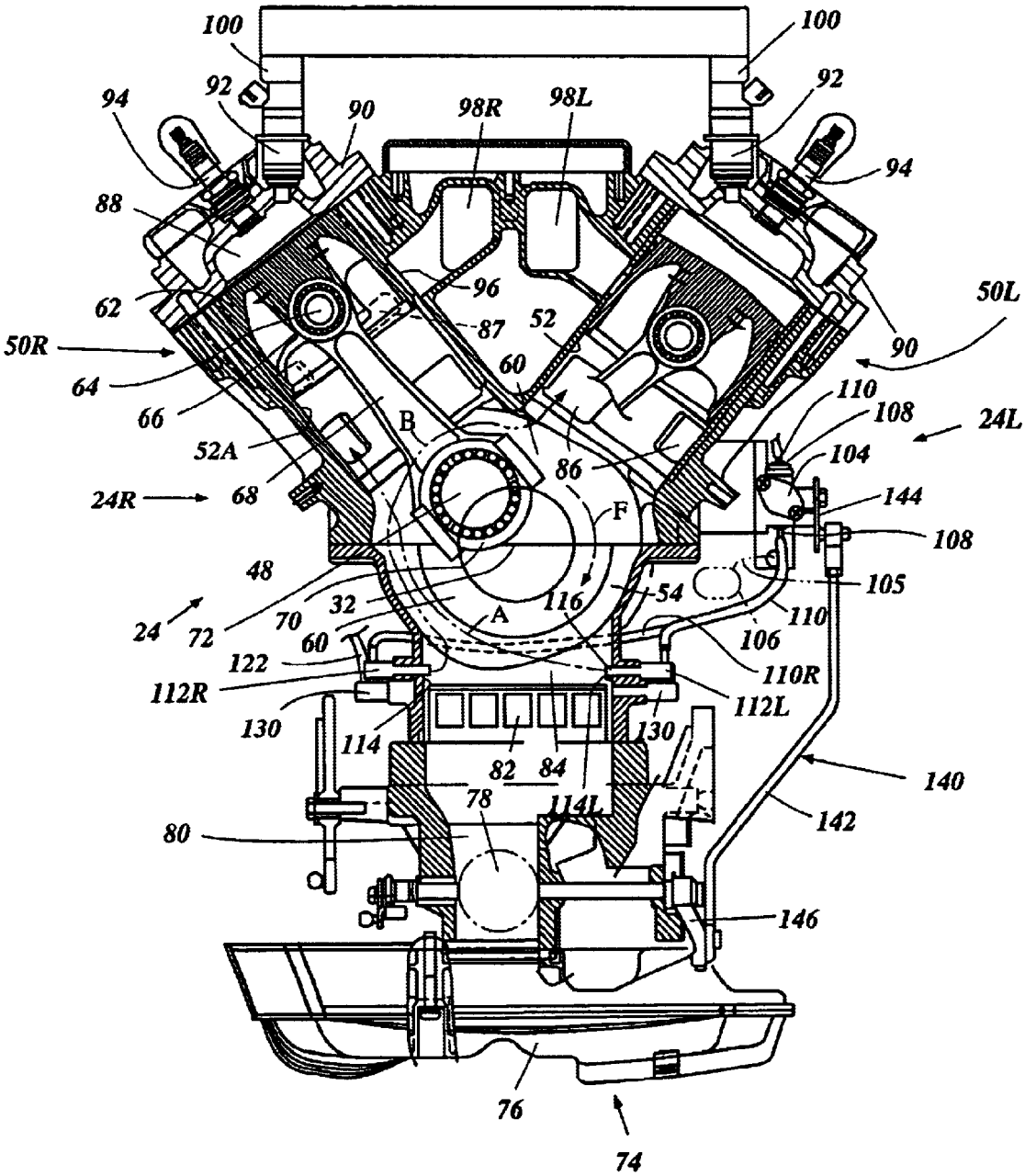
FIG. 2 is a cross-sectional view taken through the cylinders of an engine along line 2—2 of FIG. 1, the engine shown isolated from the outboard motor.

With reference to FIG. 2, the internal combustion engine 24 is preferably of a V-6 type and operates on a two stroke crankcase compression principle. Although the invention may be employed in conjunction with engines operating on other combustion principles and cycles, it will be readily apparent to those skilled in the art that it has particular utility with two stroke engines because of the manners in which they are normally lubricated. It is to be understood that the actual number of cylinders and the cylinder configuration may vary. For example, an inline four cylinder engine (see FIG. 6) or a single-cylinder engine may appropriately employ certain aspects of the invention.

The V-6 engine 24 preferably has a right (starboard) and left (port) side 24R, 24L, and includes a cylinder block 48 having a pair of angularly related cylinder banks 50L, 50R, each of which includes three cylinders 52 formed therein. As is typical with V-type engine practice, the cylinders in the cylinder banks are staggered. Thus, although a cylinder from the left and right cylinder banks is shown in the same cross-sectional view in FIG. 2, the uppermost cylinder 52A of the right cylinder bank is actually oriented vertically higher than the uppermost cylinder of the left cylinder bank 50L.

The cylinder banks 50L, 50R are attached to a central crankcase 54 which houses a substantially vertically oriented crankshaft 32. The crankcase 54 is divided into crankcase chambers 60, one chamber corresponding to each of the cylinders 52. Each cylinder 52 includes a piston 62 supported within the cylinder and adapted for reciprocating movement. A piston pin 64 rotatably attaches the piston 62 to a small end 66 of a connecting rod 68. A large end 70 of the connecting rod 68 is journaled onto a throw 72 of the crankshaft 32. The crankshaft 32 and connecting rods 68 are preferably adapted so that the crankshaft 32 turns in a clockwise position as viewed from the top plan view. It is to be understood, however, that a counterclockwise direction may also be used in conjunction with an appropriate transmission.

With reference again to FIG. 2, an air charge is supplied to each individual crankcase chamber 60 by an induction system 74. The induction system 74 includes an air inlet device 76 that draws atmospheric air from the area within the protective cowling 26. A throttle body is 78 positioned in an air passage 80 and regulates the volume of air supplied. An air guide 84 is preferably integrally joined with the front side of the crankcase chamber 60. Valves 82 are positioned within the air guide downstream of the throttle body 78. Various valve types, such as rotary valves or reed valves, can suitably be employed for the valve 82. Most preferably, the valves 82 comprise one-way valves. Each valve 82 preferably regulates and facilitates the passage of the air charge into the corresponding crankcase chamber 60.

Air from the chamber travels through scavenge passages 86 formed in the cylinder block 48, through scavenge ports 87 and into a combustion chamber 88 formed between the piston 62, cylinder walls and a cylinder head 90. The preferred embodiment uses three scavenge passages 86 per cylinder 52; however, it is to be understood that any suitable scavenge system with any number of scavenge passages per cylinder may be used in a manner known in the art.

Fuel is preferably injected directly into the combustion chamber 88 by a fuel injector 92 disposed on the cylinder head 90. Fuel is preferably supplied to the fuel injectors 92 by a fuel rail 100. The air/fuel mixture is preferably sparked and burned by a spark plug 94 also disposed in the cylinder head 90.

After combustion, the exhaust products exit the combustion chamber through an exhaust port 96. Each bank of cylinders 50L, 5OR has a dedicated exhaust manifold 98L, 98R for receiving and directing the exhaust products from each cylinder 52 in the respective cylinder bank 50L, 50R.

A lubrication system is provided for lubricating the moving engine components. With next reference to FIGS. 2–4, the lubrication system includes a lubricant pump 104 preferably mounted on the left side 24L of the engine 24. The pump 104 is preferably mechanically driven by the crankshaft 32 and draws lubricant through a supply line 105 from a source of lubricant such as an oil tank 106. The pump 104 preferably includes six ports 108, one corresponding to each crankcase chamber. Each port 108 is connected by a hose 110 to a lubricant insertion port 112L, 112R in the left or right wall 114L, 114R, respectively, of the air guide 84 of each crankcase chamber 60.

As discussed above, FIG. 2 illustrates a cylinder from both the right and left cylinder banks in the same view. Accordingly, although insertion ports 112L, 112R appear in the Figure to open into the same crankcase chamber, they actually open into separate crankcase chambers. For cylinders in the right cylinder bank 50R, the corresponding lubricant insertion ports 112L extend through the left wall 114L of the air guide 84. For cylinders in the left cylinder bank 50L, the corresponding lubricant insertion ports 112R extend through the right wall 114R of the air guide 84.

The hoses 110R that supply the insertion ports 112R in the right side 24R of the engine 24 connect to the pump 104 on the left side 24R of the engine, but cross over to the right side of the engine to communicate with the right insertion ports 112R.

The clockwise rotation of the crankshaft 32 creates a corresponding clockwise swirling air flow F within the crankcase chamber 60. Lubricant inserted into the crankcase chamber 60 is caught up in this swirling flow and generally follows a clockwise path through the crankcase chamber 60. With specific reference to FIG. 2, the portion of the lubricant inserted by the insertion ports 112L in the left wall 114L of the air guide 84 generally follows pathway A when traveling through the crankcase 60 to the corresponding cylinder 52 in the right cylinder bank 50R. Similarly, lubricant inserted through the insertion ports 112R in the right wall 114R of the air guide 84 generally follows pathway B to the corresponding cylinder 52 in the left cylinder bank 50L.

As lubricant moves generally along the flow paths A, B from the insertion port to the cylinder, at least part of the lubricant is deposited on components such as the crankshaft 32, connecting rod 68 and crankcase walls 114. Lubricant deposited on these components likely doesn't reach the cylinders 52. The longer the flow path between the insertion port and the cylinder, the greater the proportion of lubricant that will be deposited on crankcase chamber components, lessening the proportion of lubricant that will be delivered to the cylinder. Since pathways A and B are generally similar in length, substantially the same volume of lubricant is delivered to the cylinders 52 in both the right and left cylinder banks 50R, 50L. This arrangement of the insertion ports 112L, 112R results in substantially consistent dispersion of lubricant.

Each lubricant insertion port 112 preferably includes a tip 116 that extends into the air passage from the air guide wall 114L. The tip 116 preferably extends into the air passage a distance of about 5 to 20 mm and more preferably about 10 mm. Each lubricant insertion port 112 is preferably positioned downstream of the reed valve 82 and immediately adjacent the valve's downstream end. This arrangement enables the tip 116 to place the lubricant insertion port 112 directly in the air flow through the valve 82.

Positioning the lubricant insertion port 112 immediately downstream of the reed valves 82 takes advantage of the significant air flow through the reed valves 82. The combined effect of this air flow and the clockwise swirling flow F within the crankcase chamber 60 is that the lubricant is caught up in the flow and is well distributed about the crankcase chamber 60, fully lubricating moving components such as the pistons 63 and connecting rods 68.

In addition to being positioned downstream of the corresponding reed valves 82, the right insertion ports 112R are adapted to insert lubricant in a flow direction substantially opposite to the swirling airflow F within the crankcase chamber 60. Due to the opposing flow directions, the inserted flowing lubricant is separated into a relatively fine mist. The misted lubricant spatters on engine components with a more uniform consistency, thus providing more consistent lubrication than lubricant that has not been so separated.

It is to be understood that lubricant can be inserted continuously or intermittently and still benefit from the advantages of the present invention. Also, the lubricant may be discharged as a linear injection, a spray or even a drip. Although it is preferable to have the tip 116 extend from the wall 114 of the air guide 84, placement of the lubricant insertion port 112 immediately downstream of the reed valves 82 is still beneficial even if the port discharges oil directly from an outlet in the wall 114.

Those of skill in the art will appreciate that alternative lubricant injection port orientations may also be beneficial in certain applications. For example, although the lubricant insertion port 112 is depicted extending in a direction substantially perpendicular to the air guide passage, the port may be oriented to be directed more toward the crankshaft.

Figure 5:
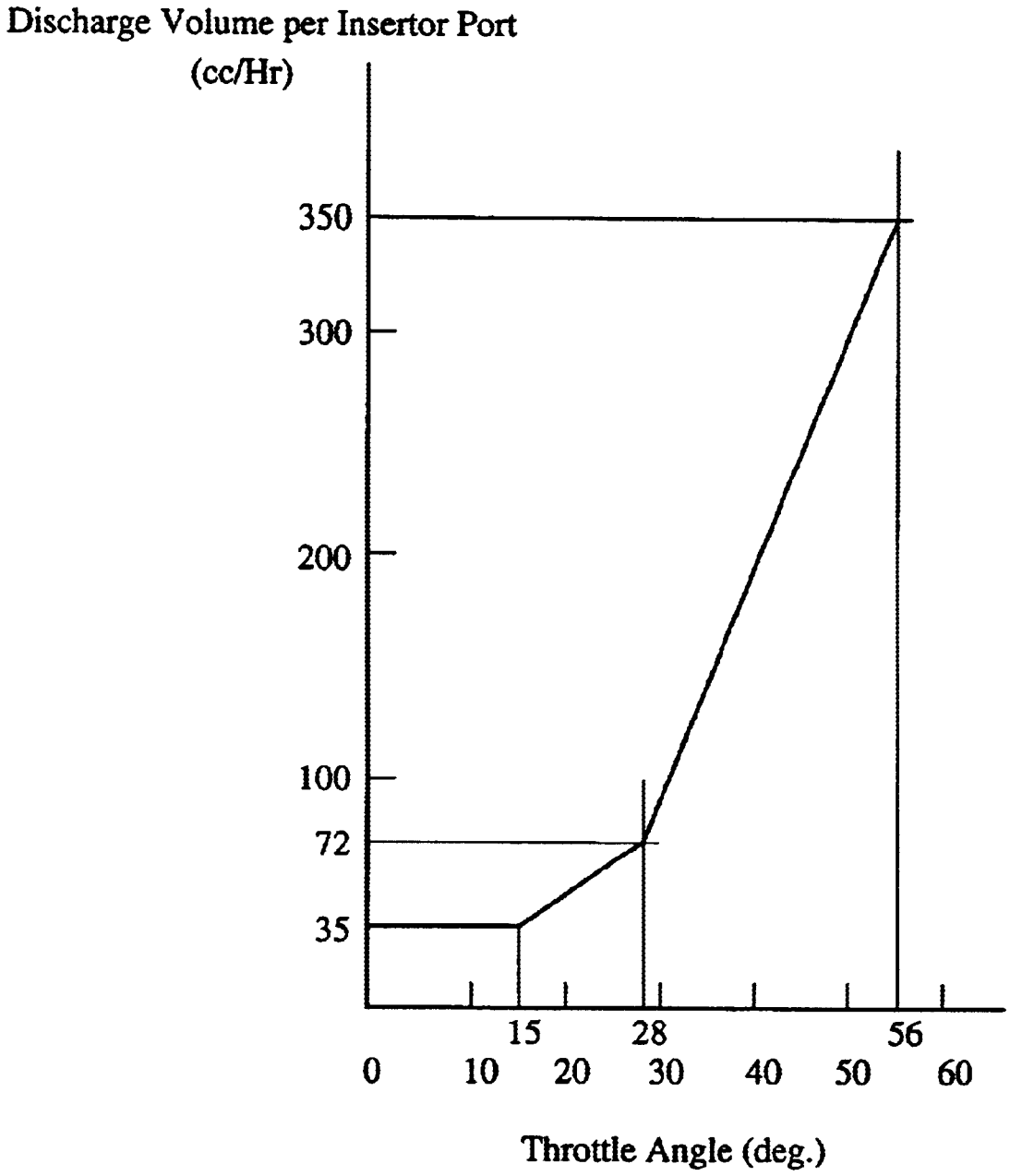
FIG. 5 is a graph showing the relationship between throttle angles and lubricant volumes delivered by the lubricant pump.

The throttle body 78 is preferably connected to the lubricant pump 104 through a control mechanism 140. The control mechanism 140 is adapted so that the lubricant discharge rate of the pump is related to the throttle body angle in the nonlinear manner shown in FIG. 5. The control mechanism 140 includes a linkage arm 142 which connects to a pump actuator 144 and a throttle body actuator 146. The pump actuator 144 adjusts the pumping volume of the pump 104, and the throttle body actuator 146 changes position with the changing angle of the throttle body 78. As the throttle angle is adjusted, a corresponding adjustment to the pump 104 increases or decreases the volume of lubricant to be delivered to the crankcase. Increased engine speeds are associated with increased throttle angles. In this manner, the amount of lubricant delivered to the crankcase chamber is increased in general relation to engine speed.

At least one scavenging passage 86 of each cylinder 52 is preferably equipped with a drain port 120, which communicates through a hose 122 with a return port 130. Lubricant in the scavenge passages flows through the corresponding return port 130 into the crankcase chamber 60. Each return port 130 is preferably positioned in the wall 114 of a crankcase chamber's air guide 84 and near the lubricant insertion port 112. Check valves between the drain port 120 and return port 130 allow lubricant from the scavenge passages 86 to flow toward the crankcase chamber 60, but prevent flow in the opposite direction.

The cylinders 52 of the left bank 50L preferably drain to return ports 130 extending through the air guide left wall 114L and the cylinders of the right bank 50R preferably drain to return ports 130 extending through the air guide right wall 114R.

Figure 3:
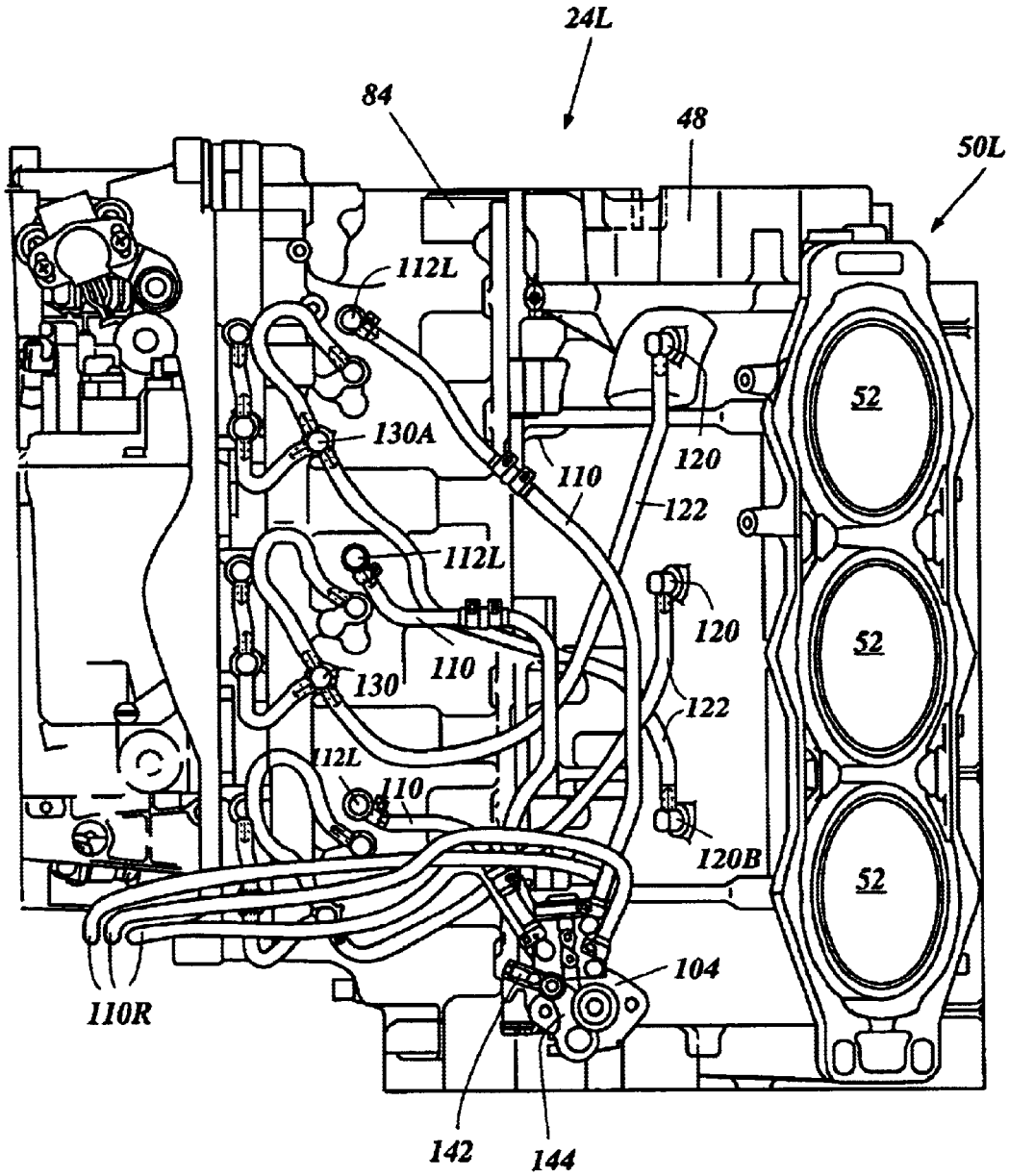
FIG. 3 is a left (port) side view of the engine of FIG. 2.
Figure 4:
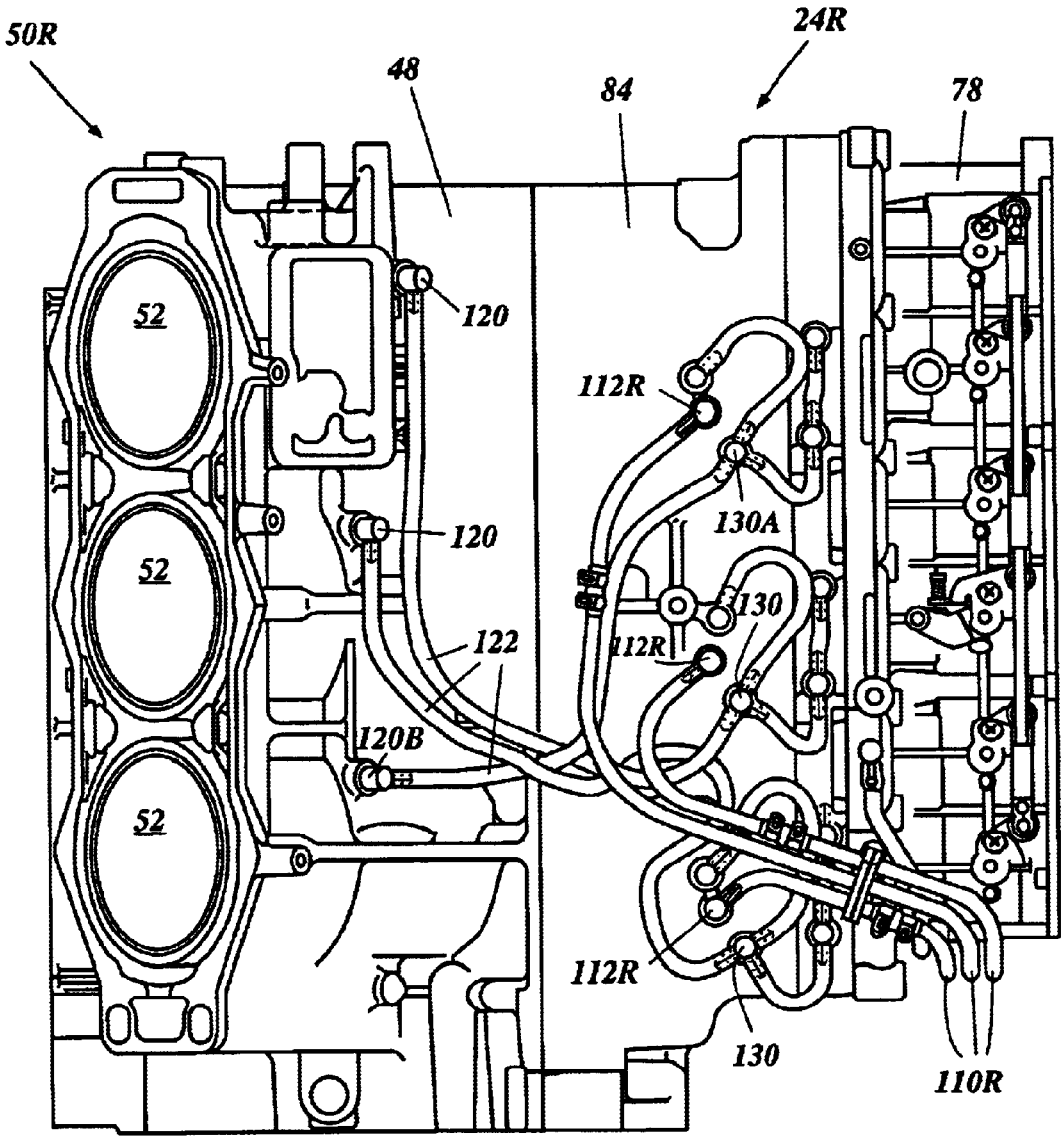
FIG. 4 is a right (starboard) side view of the engine of the FIG. 2.

The return port 130 of a given cylinder's crankcase chamber is generally vertically higher than the cylinder's drain port 120. To aid in the flow of lubricant from drain ports to return port and, as shown in FIGS. 3 and 4, each drain port preferably communicates with the return port opening into the crankcase chamber of the vertically next lowest cylinder of the particular cylinder bank. Thus, gravity aids the flow of lubricant from the drain port to the return port. Also, because the drain port and return port communicate between different crankcase chambers, differential pressures between the chambers will, in effect, pump draining lubricant from the drain port to the corresponding return port.

Because there is no lubricant return port located below the lowermost drain port 120B, the lowermost drain port 120B is connected to a vertically higher lubricant return port 130, preferably the uppermost return port 130A. Although the crankcase chambers 60 are basically sealed from each other, condensed lubricant tends to seep downwardly to the lowermost chambers. Communicating lubricant from the lowest drain ports to return ports near the top of the engine helps prevent accumulation of lubricant in the bottom portions of the engine.

When an engine is assembled according to conventional methods, the mechanical lubricant pump 104 is first interlocked with the crankshaft 32. The hoses 110 and the lubricant supply line 105 are then connected to the lubricant ports 112 and oil tank 106 as appropriate. The supply line 105 and hoses 110, however, are typically not filled with lubricant at the time of assembly. As a result, when the engine is first started, it may take several tens of seconds for lubricant to fill the hoses and begin to be delivered into the crankcase chamber 60. This lack of lubricant during the crucial break-in period can have a damaging effect on engine components and can adversely affect the longevity of the engine.

When an engine is assembled in accordance with a preferred embodiment of the present invention, the lubricant pump 104 is first connected to the lubricant supply line 105 and hoses 110, which are connected to the lubricant tank 106 and the lubricant insertion ports 112 as appropriate. The lubricant pump 104 is then manually driven, for example by an operator's hand, so that lubricant fills the supply line 105, pump 104 and hoses 110. After the hoses are substantially filled with lubricant, the pump 104 is installed in a manner so that the crankshaft 32 can mechanically drive the pump. By using this method of assembly, lubricant is discharged from the insertion ports substantially immediately upon initial start-up of the engine during break-in, substantially immediately providing lubricant to moving components within the engine.

Figure 6:
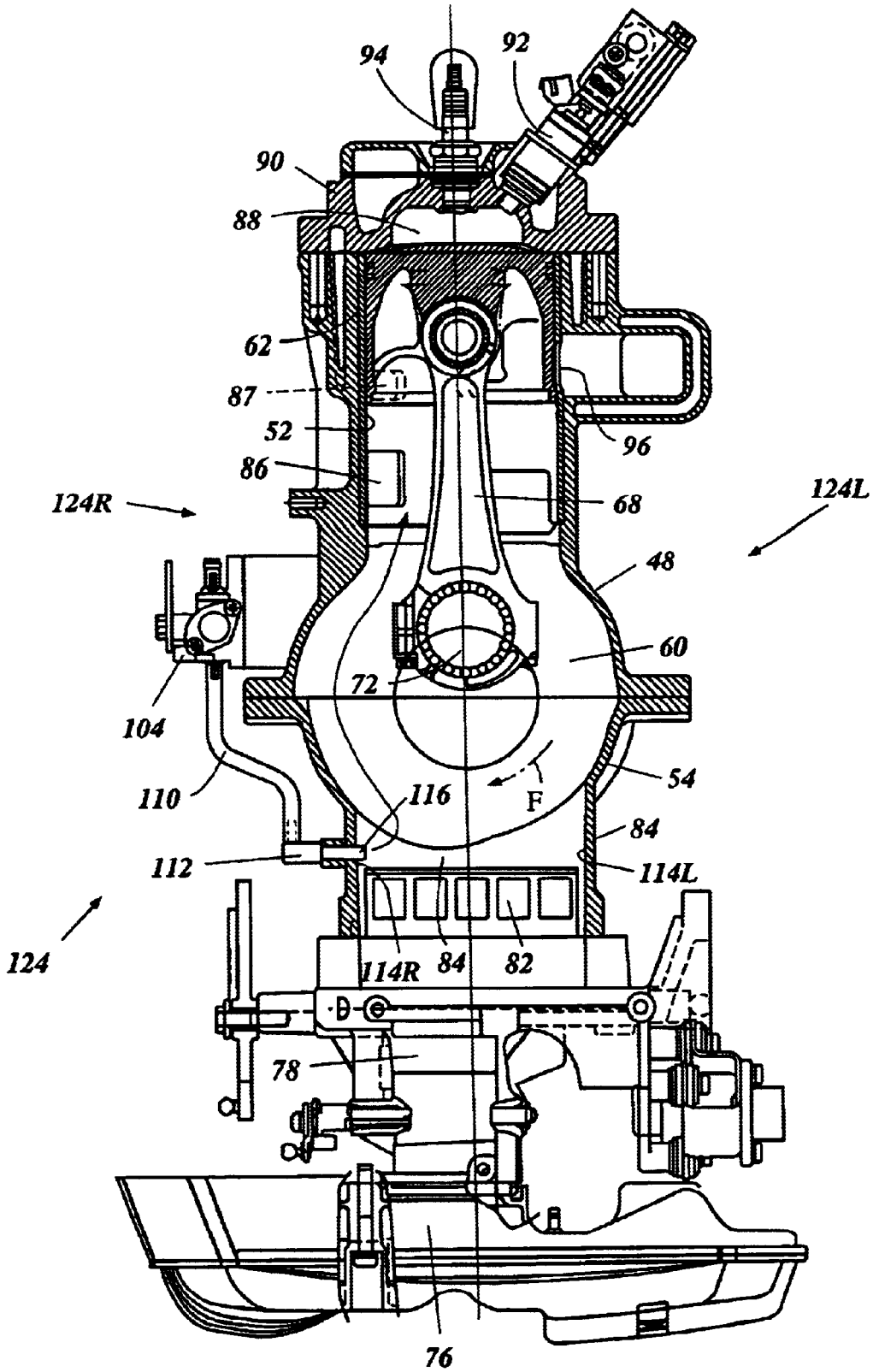
FIG. 6 is a cross-sectional view taken through the cylinders of a further embodiment of an engine along line 2—2 of FIG. 1, the engine shown isolated from the outboard motor

With reference to FIG. 6, an inline-type fuel injected two-cycle engine 124 is disclosed. This engine 124 has many components in common with engine 24 of FIG. 2. These components, such as the fuel injector 92, piston 62, crankshaft 32 and crankcase chamber 60 are identified with the same reference numerals used above with reference to the V-type engine 24 of FIG. 2. As with the engine discussed above, the crankshaft 32 is adapted to rotate in a generally clockwise direction, thereby creating a swirling flow F of air within the crankcase. A lubricant pump 104 is disposed on the right side 224R of the engine and supplies lubricant through a hose 110 to a lubricant insertion port 112 extending through a right wall 114R of the air guide 84 of the crankcase chamber 60 and downstream of the valve 82. The insertion port 112 injects lubricant into the crankcase chamber 60 in a direction substantially opposite to the swirling airflow F within the crankcase chamber. As discussed above, the inserted flowing lubricant is separated into a relatively fine mist by the opposing swirling airflow F. The misted lubricant spatters on engine components in a more consistent manner than a stream of lubricant that is not so separated.

Figure 7:
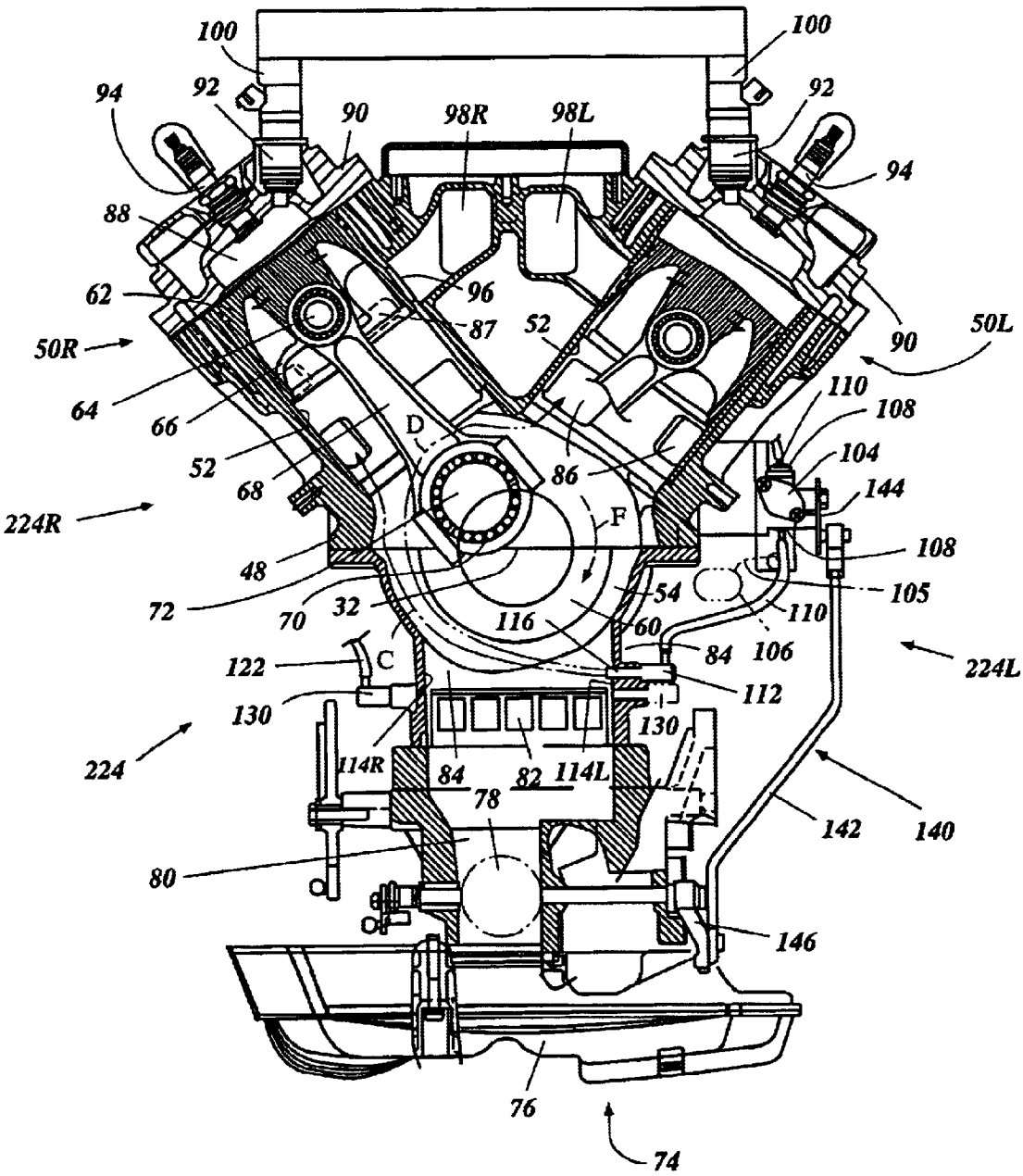
FIG. 7 is a cross-sectional view taken through the cylinders of a still further embodiment of an engine along line 2—2 of FIG. 1, the engine shown isolated from the outboard motor

At least some of the advantages of the embodiment described above with reference to FIG. 2 can be further appreciated by comparing the embodiment with FIG. 7. FIG. 7 shows an engine 224 similar to that of FIG. 2, except that insertion ports 112 for all cylinders extend through the left wall 114L of the air guide 84. In this arrangement, lubricant that travels to cylinders 52 of the right cylinder bank 5OR generally follows pathway C, while lubricant delivered to the left cylinder bank 50L generally follows pathway D. Lubricant is needed in the cylinder 52 on the crankcase side of the piston 62 to adequately lubricate the repeating piston movement relative to the cylinder wall 52; however, excessive lubrication may allow excess lubricant to enter the combustion chamber, leading to increased emissions. A lubricant delivery rate is preferably selected to provide adequate lubrication to the cylinder, but avoid excessive lubrication.

Since pathway D is significantly longer than pathway C, a greater proportion of the lubricant generally following pathway D is deposited on components such as the crankcase wall 114 and crankshaft 32 before reaching the cylinder 52 than the lubricant generally following pathway C. Accordingly, cylinders of the left cylinder bank 50L can be expected to receive a lesser proportion of injected lubricant than cylinders of the right cylinder bank 50R. In fact, cylinders in the left cylinder bank 50L may not receive enough lubricant if the lubricant delivery rate is selected to provide an optimum volume of lubricant for cylinders in the right cylinder bank 50R, while cylinders in the right cylinder bank 50R may receive excessive lubricant if the lubricant delivery rate is selected to provide an optimum volume of lubricant for cylinders in the left cylinder bank 50L.

Positioning the insertion ports 112L corresponding to the right cylinder bank 50R through the left wall 114L and the insertion ports 112R corresponding to the left cylinder bank 50L through the right wall 114R leads to substantially consistent dispersion of lubricant in cylinders of both the right and left cylinder banks, and allows a lubricant delivery rate to be selected to provide an optimum volume of lubricant for cylinders in both cylinder banks.

Excessive heat can cause lubricants such as oil to at least partially carbonize. Carbonization within the crankcase chamber can have adverse effects, such as causing the lubricant to be less effective and possibly causing accumulation of carbonized oil, which can gum up engine components. Also, carbonization may indicate inadequate lubricant distribution, because inadequately lubricated components generate excessive heat due to excessive friction. It has been found that carbonization can be substantially avoided or inhibited if lubricant is provided to each crankcase chamber at a rate of about 20 cc/hour or more during low speed engine operation such as idling.

Since lubricant is not mixed with the fuel, the viscosity of the lubricant is generally much higher than in conventional two-cycle engines. In cold weather, this viscosity can increase further. If the discharge volume of the lubricant for each crankcase chamber is excessive during low speed operation, such as when idling, the engine may become very difficult to start, especially in cold weather. This is at least partly because the excessive volume of highly viscous lubricant increases resistance to crankshaft rotation within the crankcase chamber. This resistance can make it difficult or impossible for the crankshaft to reach the required rotational speed to enable starting of the engine. It has been found that a lubricant insertion rate less than about 55 cc/hr during idling engine speeds avoids this excessive resistance.

In a preferred embodiment, the lubricant pump delivers between about 20 cc/hour and 55 cc/hour of lubricant to each crankcase chamber during idling operation. In order to minimize lubricant consumption, it is preferred to deliver a minimal volume of lubricant; however, it is anticipated that variations in the manufacturing of the lubricant pump, insertion ports, hoses or other components may case significant variations in the amount of lubricant actually supplied to each the crankcase chamber. For example, an error of about ±7 cc/hour, or even ±10 cc/hour, can be expected. Accordingly, the pump more preferably delivers between about 20–40 cc/hour of lubricant during idling operation, and still more preferably delivers between about 20–34 cc/hour. Such lubrication delivery rates have been found to improve lubrication efficiency while providing appropriate lubrication to engine components. For example, by delivering about 35 cc/hour of lubricant to each crankcase chamber, a 25% reduction in oil consumption has been observed compared with prior two-cycle engines. Also, because the lubricant is not mixed with fuel, formation of an oil layer on the engine components within the crankcase chamber can be enhanced.

With reference again to FIG. 5, an exemplary lubricant discharge rate chart is provided for an alternative embodiment wherein the lubricant volume delivered to each chamber during idling is about 35 cc/hour. As discussed above, the discharge rate of lubricant preferably varies in a nonlinear relation to the angle of the throttle valve 78. As the throttle angle increases from idle, there is a corresponding increase in the lubricant volume discharge rate. In this manner, the amount of oil delivered to the crankcase chamber is increased generally in relation to engine speed.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. An internal combustion engine comprising a first cylinder formed in a first cylinder bank, a second cylinder formed in a second cylinder bank, the cylinder banks oriented in a V-shaped formation with the first cylinder bank being generally on a first side of the engine and the second cylinder bank being generally on a second side of the engine, a crankcase enclosing at least a portion of a crankshaft therein, the crankshaft adapted to rotate in a manner creating a swirling flow of air within the crankcase, the crankcase divided into at least a first crankcase chamber communicating with the first cylinder and a second crankcase chamber communicating with the second cylinder, a first lubricant insertion port opening into the first crankcase chamber from the second side of the engine, and a second lubricant insertion port opening into the second crankcase chamber from the first side of the engine, the lubricant insertion ports communicating with a source of lubricant, the second lubricant insertion port opening into the second crankcase chamber in a direction substantially opposite the swirling flow, the source of lubricant being regulated by a control mechanism so that each lubricant insertion port delivers about 20–55 cc/hr of lubricant during engine idle.

2. The internal combuation engine of claim 1, wherein lubricant inserted through the first lubricant insertion port follows a first path generally along the swirling flow from the first port to the first cylinder, and lubricant inserted through the second lubricant insertion port follows a second path generally along the swirling flow from the second port to the second cylinder, and the lubricant insertion ports are arranged on the engine such that the first and second paths have substantially the same length.

3. An internal combustion engine comprising a first cylinder formed in a first cylinder bank, a second cylinder formed in a second cylinder bank, the cylinder banks oriented in a V-shaped formation with the first cylinder bank being generally on a first side of the engine and the second cylinder bank being generally on a second side of the engine, a crankcase enclosing at least a portion of a crankshaft therein, the crankcase divided into at least a first crankcase chamber communicating with the first cylinder and a second crankcase chamber communicating with the second cylinder, a first lubricant insertion port opening into the first crankcase chamber from the second side of the engine, and a second lubricant insertion port opening into the second crankcase chamber from the first side of the engine.

4. The internal combustion engine of claim 3, wherein the crankshaft is adapted to rotate in a first direction, thereby creating a swirling flow within each crankcase chamber, and lubricant inserted through the first lubricant insertion port follows a first path generally along the swirling flow from the first port to the first cylinder, and lubricant inserted through the second lubricant insertion port follows a second path generally along the swirling flow from the second port to the second cylinder, and the lubricant insertion ports are arranged on the engine such that the first and second paths have substantially the same length.

5. The internal combustion engine of claim 3, additionally comprising a lubricant pump attached to the first side of the engine and communicating with the first and second lubricant insertion ports.

6. The internal combustion engine of claim 5, wherein the pump communicates with the first port through a first hose and with the second port through a second hose, and the first hose extends around the engine from the pump to the first port.

7. The internal combustion engine of claim 5, wherein the pump is adapted to supply about 20–55 cc/hr of lubricant through each of the lubricant insertion ports when the engine is idling.

8. The internal combustion engine of claim 7, wherein the lubricant pump communicates with a throttle through a linkage, the linkage adapted so that a change in an angle of the throttle when the engine is operated above an idle actuates the lubricant pump to effect a corresponding change in the volume of lubricant delivered to the crankcase.

9. The internal combustion engine of claim 8, wherein the linkage is adapted so that the volume of lubricant delivered to the crankcase changes nonlinearly related to the throttle angle.

10. The internal combustion engine of claim 3, additionally comprising an air guide communicating with an air inlet device and adapted to conduct a flow of air into the crankcase, the air guide comprising a plurality of values for regulating air flow into corresponding crankcase chambers, and each insertion port is positioned downstream of and adjacent to the corresponding valve.

11. The internal combustion engine of claim 3, additionally comprising a combustion chamber adjacent one of the cylinders and being defined by at least a pair of components that move relative to each other, and a fuel injector communicating with the combustion chamber and adapted to direct a flow of fuel into the combustion chamber.

12. The internal combustion engine of claim 3, additionally comprising a combustion chamber adjacent one of the cylinders and being defined by at least a pair of components that move relative to each other, and a scavenge system adapted to supply air from the crankcase to the combustion chamber.

13. An internal combustion engine comprising at least one variable volume combustion chamber, the combustion chamber being defined by at least a pair of components that move relative to each other, a crankcase at least partially enclosing a crankshaft therein and having an air guide, the air guide communicating with an air inlet device and adapted to conduct a flow of air into the crankcase, the crankshaft communicating with one of the combustion chamber components and adapted to rotate in a manner creating a swirling flow of air within the crankcase, and a lubricant insertion port, the port communicating with a source of lubricant and opening into the crankcase in a direction substantially opposite the swirling flow.

14. The internal combustion engine of claim 13, including a valve for regulating air flow through the air guide into the crankcase, and the port is positioned on a downstream side of the valve.

15. The internal combustion engine of claim 14, wherein the port extends through the air guide of the crankcase.

16. The internal combustion engine of claim 13, additionally comprising a second variable volume combustion chamber defined by at least a second pair of components that move relative to each other, at least one of the second pair of components communicating with the crankshaft, and a second lubricant insertion port opening into the crankcase in a direction substantially aligned with the swirling flow.

17. The internal combustion engine of claim 13, wherein the crankcase is divided into a plurality of crankcase chambers, and the engine comprises a plurality of cylinders, each of the cylinders communicating with a corresponding one of the crankcase chambers, the cylinders being positioned adjacent one another in a generally inline arrangement, and a lubricant insertion port opens into each of the crankcase chambers so as to direct lubricant into the chamber in a direction substantially opposite the swirling flow.

18. An internal combustion engine having at least one variable volume combustion chamber, the combustion chamber being defined by at least a pair of components that move relative to each other, a fuel injector communicating with the combustion chamber and adapted to direct a flow of fuel into the combustion chamber, a crankcase enclosing a crankshaft therein and having an air guide, the air guide communicating with an air inlet device and adapted to conduct a flow of air into the crankcase, the crankshaft connected to one of the combustion chamber components and adapted to rotate in a first rotation direction, a scavenge system adapted to supply air from the crankcase to the combustion chamber, and a lubricant supply system comprising an insertion port and a control mechanism, the insertion port communicating with a source of lubricant and adapted to conduct a flow of lubricant into the crankcase, the control mechanism adapted to regulate the volume flow of lubricant so that, during engine idle, about 20–55 cc/hr of lubricant is delivered to the crankcase.

19. The internal combustion engine of claim 18, wherein the lubricant supply system is adpated to supply about 20–40 cc/hr of lubricant to the crankcase at engine idle.

20. The internal combustion engine of claim 18, wherein the lubricant supply system is adpated to supply about 35 cc/h of lubricant to the crankcase at engine idle.

21. The internal combustion engine of claim 18, wherein the lubricant pump communicates with a throttle through a linkage, the linkage adapted so that a change in an angle of the throttle when the engine is operated above an idle actuates the lubricant pump to effect a corresponding change in the volume of lubricant delivered to the crankcase.

22. The internal combustion engine of claim 18, additionally comprising a second variable volume combustion chamber defined by at least a second pair of components that move relative to each other, at least one of the second pair of components communicating with the crankshaft, and a second lubricant insertion port communicating with the source of lubricant and adapted to conduct a second flow of lubricant into the crankcase, and the flow of lubricant through the second lubricant insertion port is substantially the same as the flow through the first lubricant insertion port.

23. An internal combustion engine having at least one variable volume combustion chamber, the combustion chamber being defined by at least a pair of components that move relative to each other, a fuel injector communicating with the combustion chamber and adapted to direct a flow of fuel into the combustion chamber, a crankcase enclosing a crankshaft therein and having an air guide, the air guide communicating with an air inlet device and adapted to conduct a flow of air into the crankcase, the crankshaft connected to one of the combustion chamber components and adapted to rotate in a first rotation direction, a scavenge system adapted to supply air from the crankcase to the combustion chamber, and a lubricant supply system comprising an insertion port and a control mechanism, the insertion port communicating with a source of lubricant and adapted to conduct a flow of lubricant into the crankcase, the control mechanism adapted to regulate the volume flow of lubricant during engine idle between a first delivery rate and a second delivery rate, the first delivery rate selected to supply a sufficient volume of lubricant to inhibit carbonization of the lubricant, the second delivery rate selected to supply a small enough volume of lubricant so that lubricant resistance to crankshaft rotation will not hinder engine start.

24. The internal combustion engine of claim 23, wherein the first delivery rate is at least about 20 cc/hr.

25. The internal combustion engine of claim 23, wherein the second delivery rate is at most about 55 cc/hr.

26. An internal combustion engine comprising a first cylinder formed in a first cylinder bank, a second cylinder formed in a second cylinder bank, the cylinder banks oriented in a V-shaped formation, a crankcase enclosing at least a portion of a crankshaft therein, the crankcase divided into at least a first crankcase chamber communicating with the first cylinder and a second crankcase chamber communicating with the second cylinder, the crankshaft configured to rotate in a first direction so as to create a swirling flow within each crankcase chamber, a first lubricant insertion port opening into the first crankcase chamber, the first port positioned so that a first lubricant flow path is defined generally along the swirling flow from the first port to the first cylinder, and a second lubricant insertion port opening into the second crankcase chamber, the second port positioned so that a second lubricant flow path is defined generally along the swirling flow from the second port to the second cylinder, wherein a length of the first lubricant flow path is generally the same as a length of the second lubricant flow path.

27. The internal combustion engine of claim 26, wherein the first lubricant insertion port is positioned on a side of the engine generally opposite the first cylinder bank.

28. The internal combustion engine of claim 26, additionally comprising a lubricant supply control mechanism, the control mechanism controlling the supply of lubricant so that each lubricant insertion port delivers about 20–55 cc/hr of lubricant during engine idle.

* * * * *